US009518382B2

(12) United States Patent
Jonte et al.

(10) Patent No.: US 9,518,382 B2
(45) Date of Patent: Dec. 13, 2016

(54) FAUCET MOUNTING ANCHOR

(75) Inventors: Patrick B. Jonte, Zionsville, IN (US); Michael Scot Rosko, Greenwood, IN (US); Todd Midkiff, Noblesville, IN (US); Michael J. Veros, Carmel, IN (US)

(73) Assignee: DELTA FAUCET COMPANY, Indianapolis, IN (US)

( * ) Notice: Subject to any disclaimer, the term of this patent is extended or adjusted under 35 U.S.C. 154(b) by 500 days.

(21) Appl. No.: 13/695,323

(22) PCT Filed: May 23, 2011

(86) PCT No.: PCT/US2011/037613

§ 371 (c)(1),
(2), (4) Date: Oct. 30, 2012

(87) PCT Pub. No.: WO2011/146940

PCT Pub. Date: Nov. 24, 2011

(65) Prior Publication Data

US 2013/0042926 A1 Feb. 21, 2013

Related U.S. Application Data

(60) Provisional application No. 61/347,270, filed on May 21, 2010.

(51) Int. Cl.
*E03C 1/04* (2006.01)

(52) U.S. Cl.
CPC ..... *E03C 1/0402* (2013.01); *E03C 2001/0415* (2013.01); *E03C 2001/0416* (2013.01); *Y10T 137/6014* (2015.04); *Y10T 137/6977* (2015.04); *Y10T 137/9464* (2015.04)

(58) Field of Classification Search
CPC ..... E03C 1/0402; E03C 2001/0416; Y10T 137/6014; Y10T 137/9464; Y10T 137/6977
USPC ..... 137/315.11–315.12, 801; 4/676–678
See application file for complete search history.

(56) References Cited

U.S. PATENT DOCUMENTS

| | | | | |
|---|---|---|---|---|
| 1,592,353 A | | 7/1926 | Gade | |
| 1,728,492 A | * | 9/1929 | Kaufman | A47K 5/02 4/678 |
| 2,173,064 A | | 9/1939 | Judell | |
| 2,591,991 A | | 4/1952 | Young | |
| 2,848,721 A | | 8/1956 | Fredrickson | |

(Continued)

FOREIGN PATENT DOCUMENTS

| | | |
|---|---|---|
| CH | 275914 | 6/1951 |
| CN | 1278584 | 1/2001 |

(Continued)

OTHER PUBLICATIONS

International Search Report and Written Opinion dated Sep. 27, 2011, PCT International Application No. PCT/US2011/037613, 9 pages.

*Primary Examiner* — Mary McManmon
*Assistant Examiner* — David Colon Morales
(74) *Attorney, Agent, or Firm* — Faegre Baker Daniels LLP

(57) ABSTRACT

A widespread faucet assembly may include one or more valve assemblies and a delivery spout. The anchors for the valve assemblies and delivery spout may be positioned within a mounting deck, and the valve assemblies and the delivery spout are releasably connected to the respective anchors to minimize installation tasks below the mounting deck.

20 Claims, 15 Drawing Sheets

(56) References Cited

U.S. PATENT DOCUMENTS 3,010,474 A 11/1961 Moen
3,012,251 A 12/1961 Fife
3,035,276 A 5/1962 Hanson
3,155,115 A 11/1964 Ziegler
3,229,710 A 1/1966 Keller, III
3,427,049 A 2/1969 Politz
3,448,768 A 6/1969 Keller, III
3,495,616 A * 2/1970 Esposito ..... 137/356
3,561,485 A 2/1971 Klingler
3,600,723 A 8/1971 Mongerson et al.
3,609,774 A 10/1971 Allgood
3,645,493 A 2/1972 Manoogian et al.
3,790,966 A 2/1974 Keane
3,796,380 A 3/1974 Johnson et al.
3,807,453 A 4/1974 Dom et al.
3,911,946 A 10/1975 Humpert et al.
3,998,240 A 12/1976 Liautaud
4,026,328 A 5/1977 Nelson
4,064,900 A 12/1977 Schmitt
4,103,709 A * 8/1978 Fischer ..... 137/615
4,186,761 A 2/1980 Guarnieri
RE30,559 E 3/1981 Schmitt
4,262,699 A * 4/1981 Fabian ..... 137/801
4,290,445 A 9/1981 Turner
4,328,830 A 5/1982 Greer
4,337,795 A 7/1982 Argyris et al.
4,356,574 A 11/1982 Johnson
4,387,738 A 6/1983 Bisonaya et al.
4,425,935 A * 1/1984 Gonzalez ..... 137/315.12
4,446,885 A 5/1984 Nolden
4,458,839 A 7/1984 MacDonald
4,513,769 A 4/1985 Purcell
4,516,753 A * 5/1985 Thomsen ..... 251/346
4,552,171 A 11/1985 Farrell et al.
4,635,673 A 1/1987 Gerdes
4,649,958 A 3/1987 Purcell
4,660,803 A 4/1987 Johnston et al.
4,671,316 A 6/1987 Botnick
4,678,002 A 7/1987 Valley
4,700,928 A 10/1987 Marty
4,706,702 A 11/1987 Grasseschi
4,747,428 A * 5/1988 Crawford et al. ..... 137/315.12
4,760,861 A 8/1988 Botnick
4,762,143 A 8/1988 Botnick
4,762,273 A 8/1988 Gregory et al.
4,771,485 A 9/1988 Traylor
4,827,538 A 5/1989 Heimann et al.
4,848,395 A 7/1989 Krippendorf
4,852,192 A 8/1989 Viegener
4,856,121 A 8/1989 Traylor
4,903,725 A 2/1990 Ko
4,911,335 A 3/1990 Stofle et al.
4,966,186 A 10/1990 Rodstein
4,998,555 A 3/1991 Barhydt, Sr. et al.
5,010,922 A 4/1991 Agresta
5,020,569 A 6/1991 Agresta
5,027,851 A 7/1991 Drees et al.
5,073,991 A 12/1991 Marty
5,090,062 A 2/1992 Hochstrasser
5,095,554 A 3/1992 Gloor
5,127,427 A 7/1992 Kajpust et al.
5,127,438 A 7/1992 Williams
5,131,428 A 7/1992 Bory
5,148,832 A 9/1992 Lin
5,165,121 A 11/1992 McTargett et al.
5,232,008 A * 8/1993 Jeffress ..... E03C 1/0401 137/15.01
5,275,199 A 1/1994 Howell
5,349,987 A 9/1994 Shieh
5,361,431 A 11/1994 Freier et al.
5,375,272 A 12/1994 Mikol
5,388,287 A 2/1995 Tischler et al.
5,458,154 A 10/1995 Niemann et al.
5,465,749 A 11/1995 Sauter et al.
5,467,799 A 11/1995 Buccicone et al.
5,515,882 A 5/1996 Hennis
5,518,016 A 5/1996 Sharwark
5,535,776 A 7/1996 Kingman
5,558,128 A 9/1996 Pawelzik et al.
5,566,707 A 10/1996 Ching et al.
5,642,755 A 7/1997 Mark et al.
5,657,791 A * 8/1997 Graber ..... 137/625.41
5,660,203 A 8/1997 Gnauert et al.
5,669,407 A 9/1997 Bailey
5,669,417 A 9/1997 Lian-Jie
5,685,341 A 11/1997 Chrysler et al.
5,687,952 A 11/1997 Arnold et al.
5,725,008 A 3/1998 Johnson
5,746,244 A 5/1998 Woolley, Sr. et al.
5,758,688 A 6/1998 Hamanaka et al.
5,797,151 A 8/1998 Ko
5,803,120 A 9/1998 Bertoli
5,813,431 A 9/1998 Cool et al.
5,822,811 A 10/1998 Ko
5,845,345 A 12/1998 Ko
5,865,211 A 2/1999 Thomas
5,865,473 A 2/1999 Semchuck et al.
5,884,662 A 3/1999 Ko
5,894,613 A 4/1999 Fenn
5,918,855 A 7/1999 Hamanaka et al.
5,924,451 A 7/1999 Kuo
5,946,746 A 9/1999 Bloom
5,950,663 A 9/1999 Bloomfield
5,960,490 A 10/1999 Pitsch
5,979,489 A 11/1999 Pitsch
5,983,917 A 11/1999 Thomas
6,006,784 A 12/1999 Tsutsui et al.
6,014,985 A 1/2000 Warshawsky
6,023,796 A 2/2000 Pitsch
6,062,251 A 5/2000 Pitsch
6,073,972 A 6/2000 Rivera
6,082,407 A 7/2000 Paterson et al.
6,085,784 A 7/2000 Bloom et al.
6,123,106 A 9/2000 Benstead
6,125,875 A 10/2000 Dempsey et al.
6,138,296 A 10/2000 Baker
6,161,230 A 12/2000 Pitsch
6,170,098 B1 1/2001 Pitsch
6,189,569 B1 2/2001 Calhoun
6,195,818 B1 3/2001 Rodstein et al.
6,202,686 B1 3/2001 Pitsch et al.
6,202,980 B1 3/2001 Vincent et al.
6,209,153 B1 4/2001 Segien, Jr.
6,220,278 B1 4/2001 Sauter et al.
6,220,279 B1 4/2001 Segien
6,256,810 B1 7/2001 Baker
6,267,136 B1 7/2001 Johnson
6,273,138 B1 8/2001 Yoney
6,273,394 B1 8/2001 Vincent et al.
6,279,604 B1 * 8/2001 Korb et al. ..... 137/359
6,301,728 B1 10/2001 Pilatowicz et al.
6,302,131 B1 10/2001 Pitsch
6,314,593 B1 11/2001 Mantel
6,328,059 B1 12/2001 Testori et al.
6,334,226 B1 1/2002 Tokunaga et al.
6,345,643 B1 * 2/2002 Ko ..... 137/315.12
6,360,770 B1 3/2002 Buchner et al.
6,360,774 B1 3/2002 Becker et al.
6,370,712 B1 * 4/2002 Burns et al. ..... 4/675
6,378,912 B1 4/2002 Condon et al.
6,381,776 B1 * 5/2002 Wang ..... 4/695
6,385,798 B1 5/2002 Burns et al.
6,405,749 B1 6/2002 Bloom et al.
6,421,849 B1 7/2002 Gray
6,422,520 B1 7/2002 Hand
6,434,765 B1 8/2002 Burns et al.
6,438,771 B1 8/2002 Donath, Jr. et al.
6,457,191 B2 10/2002 Brandelbusemeyer et al.
6,484,330 B2 11/2002 Gray et al.
6,491,058 B1 12/2002 Wang
6,571,407 B1 6/2003 Skarie
6,615,422 B2 * 9/2003 Hecker ..... 4/675
6,619,320 B2 9/2003 Parsons
6,631,730 B1 10/2003 Bloom et al.

(56) References Cited

U.S. PATENT DOCUMENTS

| | | | | |
|---|---|---|---|---|
| 6,672,628 | B2 | 1/2004 | Thomas et al. | |
| 6,684,906 | B2 | 2/2004 | Burns et al. | |
| 6,718,568 | B1 | 4/2004 | Hensley | |
| 6,725,472 | B2 | 4/2004 | Gray et al. | |
| 6,757,921 | B2 | 7/2004 | Esche | |
| 6,792,629 | B2 | 9/2004 | Nelson et al. | |
| 6,807,692 | B2 | 10/2004 | Tsutsui et al. | |
| 6,832,396 | B1 * | 12/2004 | Lin | 4/675 |
| 6,868,564 | B2 | 3/2005 | Ginter et al. | |
| 6,874,527 | B2 | 4/2005 | Meeder | |
| 6,874,535 | B2 | 4/2005 | Parsons et al. | |
| 6,912,742 | B1 | 7/2005 | Wang | |
| 6,918,400 | B2 | 7/2005 | Buchner et al. | |
| 7,017,600 | B2 | 3/2006 | Klein | |
| 7,055,545 | B2 | 6/2006 | Mascari et al. | |
| 7,174,581 | B2 | 2/2007 | McNerney et al. | |
| 7,175,158 | B2 | 2/2007 | Thomas | |
| 7,231,936 | B2 * | 6/2007 | Chang | 137/328 |
| 7,269,864 | B2 | 9/2007 | Brown et al. | |
| 7,406,980 | B2 | 8/2008 | Pinette | |
| 7,409,968 | B2 * | 8/2008 | Yang | E03C 1/0401 137/801 |
| 7,472,434 | B1 * | 1/2009 | Moldthan et al. | 4/678 |
| 7,540,300 | B2 * | 6/2009 | Thomas et al. | 137/359 |
| 7,647,939 | B2 * | 1/2010 | Lin | 137/315.12 |
| 7,661,155 | B2 * | 2/2010 | Yang | 4/678 |
| 7,698,755 | B2 | 4/2010 | McNerney et al. | |
| 7,766,043 | B2 | 8/2010 | Thomas et al. | |
| 7,979,929 | B2 | 7/2011 | Vogel et al. | |
| 2001/0011389 | A1 | 8/2001 | Philipps-Liebich et al. | |
| 2001/0044955 | A1 | 11/2001 | Brandebusemeyer | |
| 2002/0083520 | A1 | 7/2002 | Osborne-Kirby | |
| 2002/0124309 | A1 | 9/2002 | Donath, Jr. et al. | |
| 2002/0185182 | A1 | 12/2002 | Wang | |
| 2002/0189674 | A1 | 12/2002 | Meeder | |
| 2003/0204906 | A1 | 11/2003 | Tsutsui et al. | |
| 2003/0221254 | A1 | 12/2003 | McNerney et al. | |
| 2004/0034924 | A1 | 2/2004 | Underbrink et al. | |
| 2004/0060109 | A1 | 4/2004 | Hensley | |
| 2004/0094202 | A1 | 5/2004 | Kawolics et al. | |
| 2004/0123910 | A1 | 7/2004 | Yardley | |
| 2004/0143900 | A1 | 7/2004 | Nelson et al. | |
| 2004/0154673 | A1 | 8/2004 | Mascari et al. | |
| 2004/0179351 | A1 | 9/2004 | Patterson | |
| 2004/0200987 | A1 | 10/2004 | Houghton | |
| 2004/0221899 | A1 | 11/2004 | Parsons et al. | |
| 2005/0022299 | A1 | 2/2005 | Brown et al. | |
| 2005/0199843 | A1 | 9/2005 | Jost et al. | |
| 2005/0242198 | A1 | 11/2005 | Kempf et al. | |
| 2005/0242199 | A1 | 11/2005 | Kempf et al. | |
| 2005/0251907 | A1 | 11/2005 | Mintz et al. | |
| 2006/0042006 | A1 | 3/2006 | Thomas | |
| 2006/0076056 | A1 | 4/2006 | Schmitt et al. | |
| 2006/0200904 | A1 * | 9/2006 | Vogel | E03C 1/0401 4/695 |
| 2006/0237072 | A1 * | 10/2006 | Lee | 137/801 |
| 2007/0044232 | A1 | 3/2007 | McNerney et al. | |
| 2007/0271695 | A1 | 11/2007 | Thomas et al. | |
| 2008/0277003 | A1 * | 11/2008 | Mueller et al. | 137/801 |
| 2009/0101221 | A1 * | 4/2009 | Hsiao | 137/801 |
| 2009/0139024 | A1 * | 6/2009 | Vogel | E03C 1/23 4/678 |
| 2009/0255588 | A1 | 10/2009 | Bors et al. | |
| 2009/0276954 | A1 * | 11/2009 | Davidson | 4/695 |
| 2011/0094604 | A1 | 4/2011 | Thomas et al. | |
| 2013/0048100 | A1 | 2/2013 | Jonte et al. | |

FOREIGN PATENT DOCUMENTS

| | | |
|---|---|---|
| CN | 1278585 | 1/2001 |
| CN | 1278586 | 1/2001 |
| CN | 1278588 | 1/2001 |
| DE | 100 22 350 A1 | 11/2001 |
| EP | 0 808 952 B1 | 9/2003 |
| EP | 2112281 | 10/2009 |
| GB | 371616 | 5/1931 |
| JP | 2006/328812 | 12/2006 |
| WO | WO 2005/056937 | 6/2005 |
| WO | WO 2005/118966 | 12/2005 |
| WO | WO 2007/027340 | 3/2007 |
| WO | WO 2009/155529 | 12/2009 |
| WO | WO 2011/146939 | 11/2011 |

* cited by examiner

FAUCET MOUNTING ANCHOR

CROSS-REFERENCE TO RELATED APPLICATION

This application claims the benefit of U.S. Provisional Application Ser. No. 61/347,270, filed May 21, 2010, the disclosure of which is expressly incorporated by reference herein.

BACKGROUND AND SUMMARY

The present disclosure relates generally to faucets and, more particularly, to a mounting system for a two handle faucet, and a mounting system for a single mounting faucet assembly.

The installation of a faucet onto a mounting deck is often a difficult and time-consuming task. At least some of the installation may require the installer to work in the cramped and dimly lit work area under the sink or mounting deck. More particularly, faucets are typically attached to the mounting deck with threaded connections which must be made under and behind the sink basin wherein there is very little room to work.

As such, there is a need to provide a less cumbersome and complicated system of installing faucets or interchanging different faucet styles onto a mounting deck which can be done largely from the top of the countertop or sink.

According to an illustrative embodiment of the present disclosure, a faucet assembly may include a spout anchor including a spout anchor body having a first set of spout anchor threads. The faucet assembly may also include a valve anchor including an anchor body having a first set of valve anchor threads. The faucet assembly may also include a spout assembly including a bushing with threads disposed on an external surface, and an opening in the bushing extending from a first surface to a second surface, wherein the threads of the bushing engage with the first set of spout anchor threads. The faucet assembly may also include a valve cartridge surrounded by a locking ring, wherein the locking ring includes threads disposed on an external surface, the threads of the valve cartridge engaging with the first set of valve anchor threads.

In another illustrative embodiment of the present disclosure, a faucet assembly may include a spout anchor including a first set of spout anchor threads. The faucet assembly may also include a valve anchor including a first set of valve anchor threads. The faucet assembly may also include a spout assembly including a bushing with threads disposed on the external surface, and an opening in the bushing extending from a first surface to a second surface, wherein the threads of the bushing engage with the first set of spout anchor threads. The faucet assembly may also include a valve cartridge including a locking ring positioned on the external surface of the valve cartridge, wherein the locking ring includes threads disposed on the external surface, the locking ring threads engage with the first set of valve anchor threads, and the valve cartridge includes an inlet conduit and an outlet conduit, the inlet conduit and the outlet conduit being in fluid communication with the valve cartridge.

In yet another illustrative embodiment of the present disclosure, a faucet assembly may include an anchor having a first opening of a first diameter and comprising a lip structure, anchor threads, and one or more cleats disposed in one or more grooves, the one or more cleats operable to travel along the one or more grooves, the anchor operable to mount to a mounting deck. The faucet assembly may also include a faucet body comprising a waterway and a lip along the outer diameter of the faucet body. The faucet assembly may also include a locking ring surrounding the faucet body and comprising internal threads. The faucet assembly may also include a retaining ring surrounding the faucet body, the retaining ring sized so that the diameter of the retaining ring is smaller than the diameter of the faucet body lip, wherein the retaining ring engages the faucet body lip and retains the locking ring on the faucet body, wherein the internal threads of the locking ring releasably engage the anchor threads and releasably attach the faucet body to the anchor.

Additional features and advantages of the present disclosure will become apparent to those skilled in the art upon consideration of the following detailed description of the illustrative embodiment exemplifying the best mode of carrying out the disclosure as presently perceived.

BRIEF DESCRIPTION OF THE DRAWINGS

The detailed description of the drawings particularly refers to the accompanying figures in which.

Figure 1:
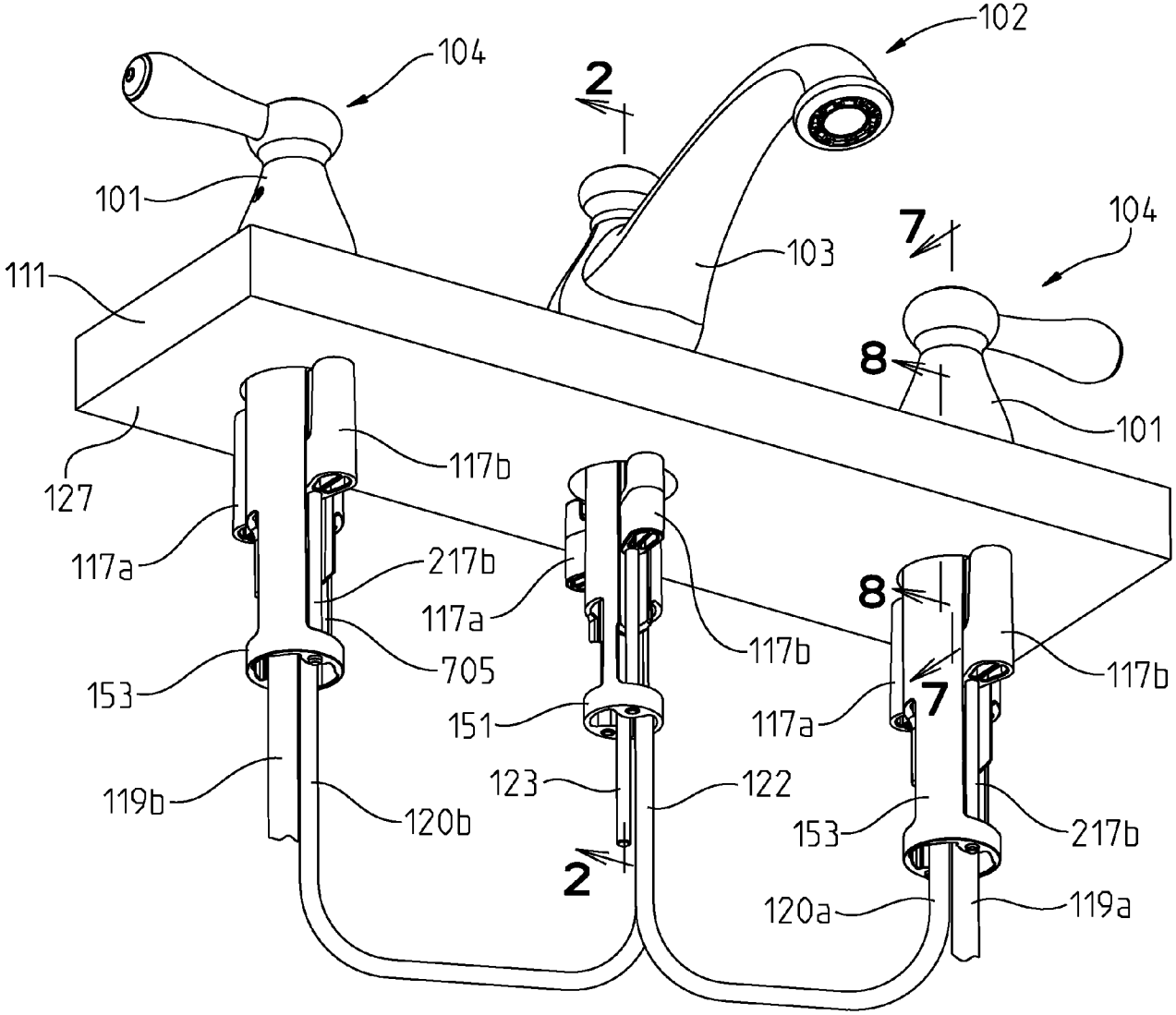
FIG. 1 is a bottom perspective view of a faucet according to an embodiment of the present disclosure.
Figure 2:
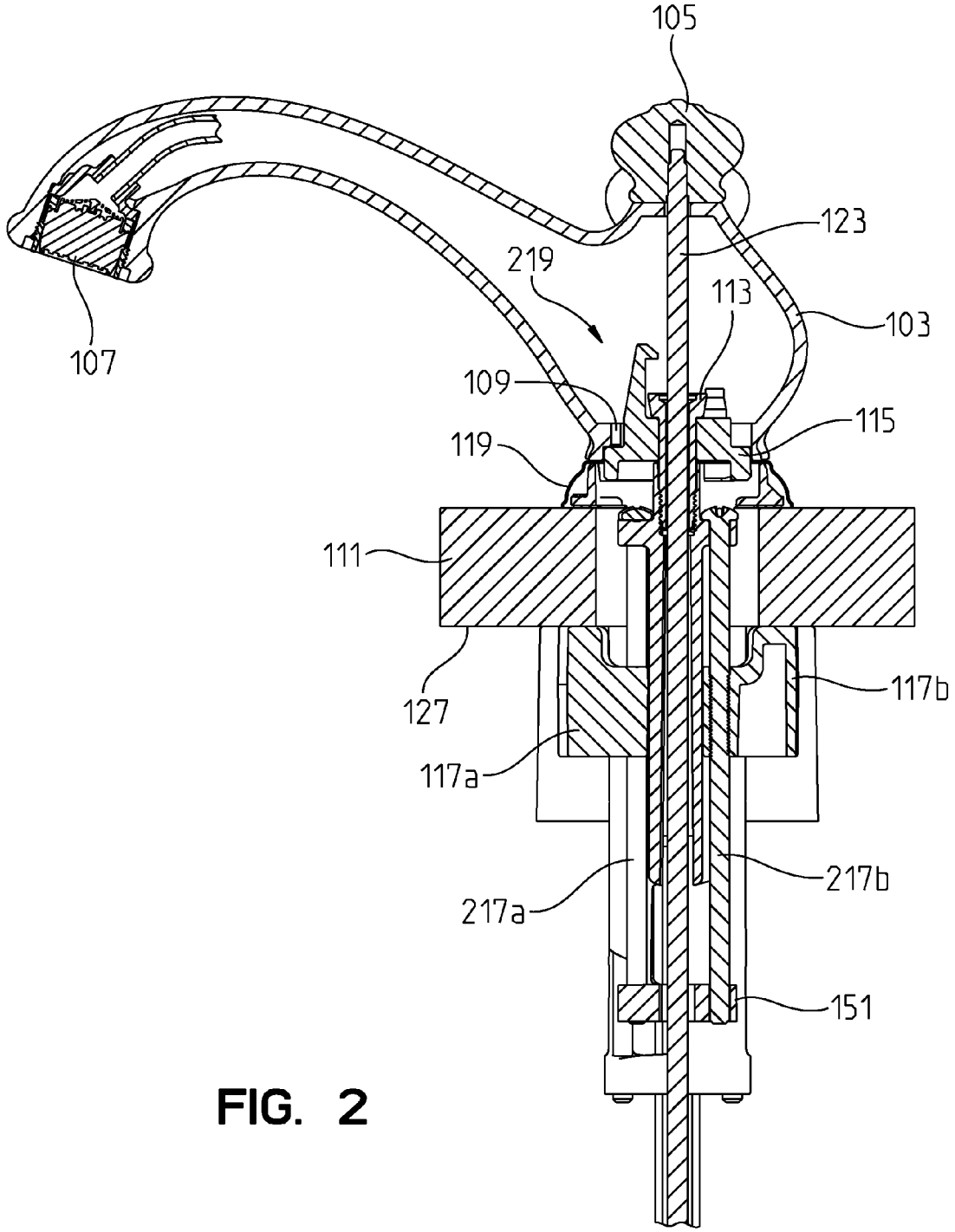
FIG. 2 is a cross-sectional view of the spout taken along line 2-2 of FIG. 1.
Figure 3B:
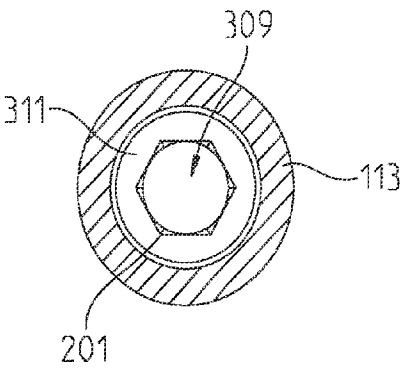
FIG. 3B is a cross-sectional view of the bushing taken along line 3B-3B of FIG. 3A.
Figure 3A:
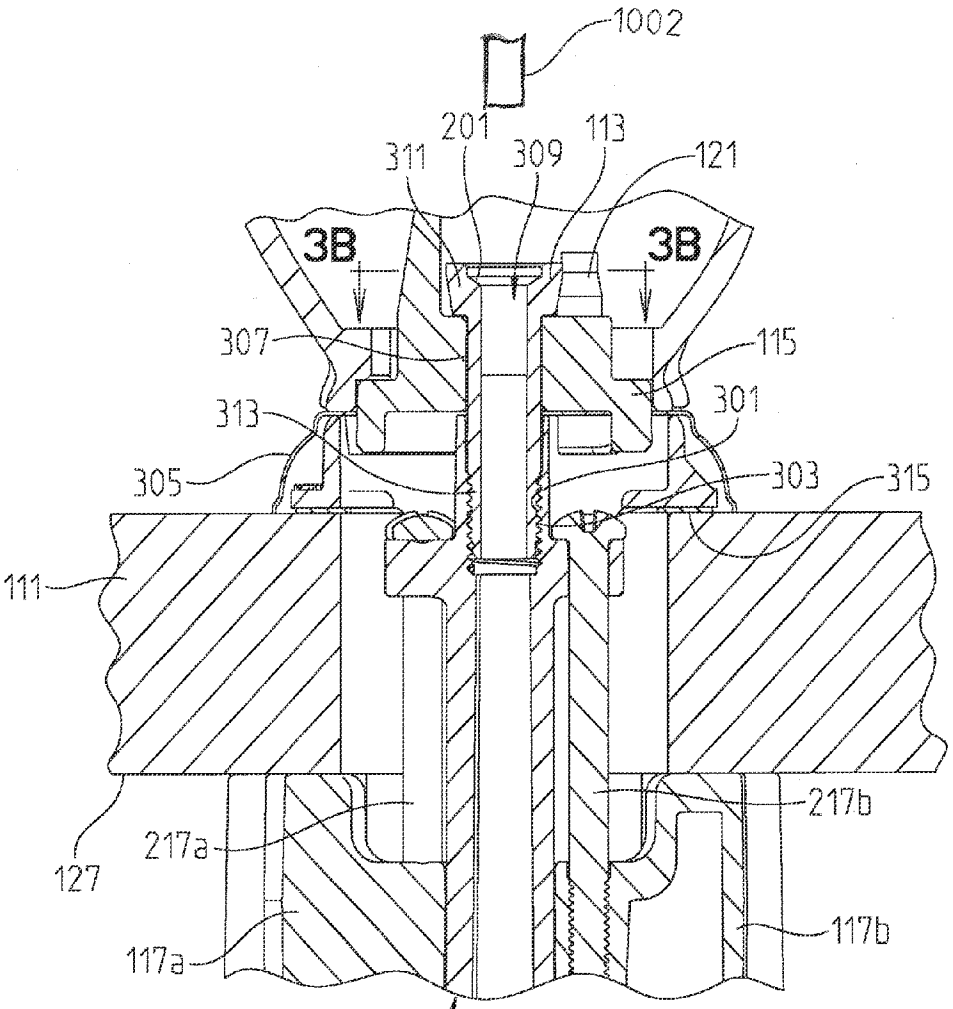
FIG. 3A is a detailed view of the faucet of FIG. 2.
Figure 4:
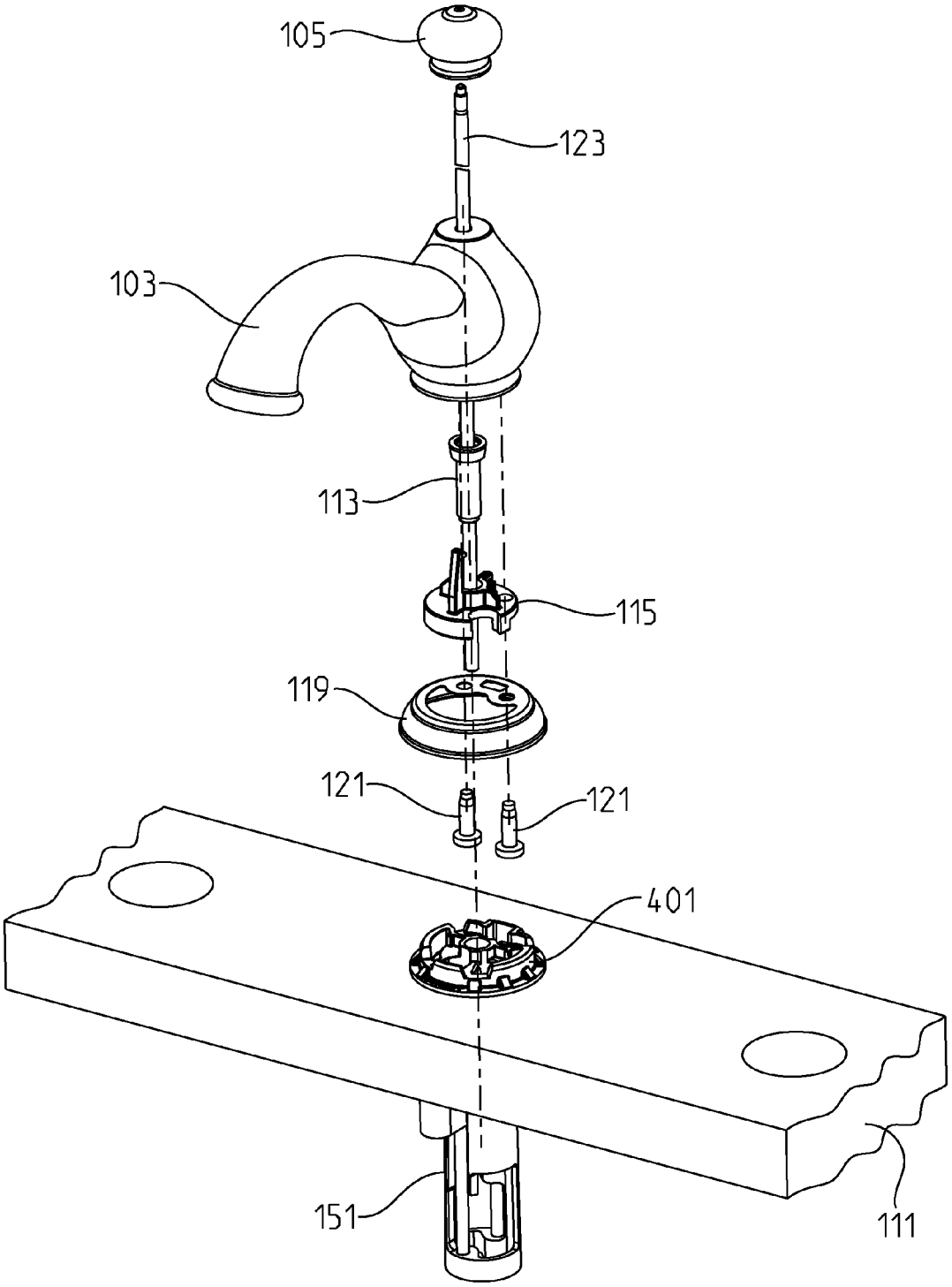
FIG. 4 is an exploded perspective view of the spout of the faucet of FIG. 2.
Figure 5:
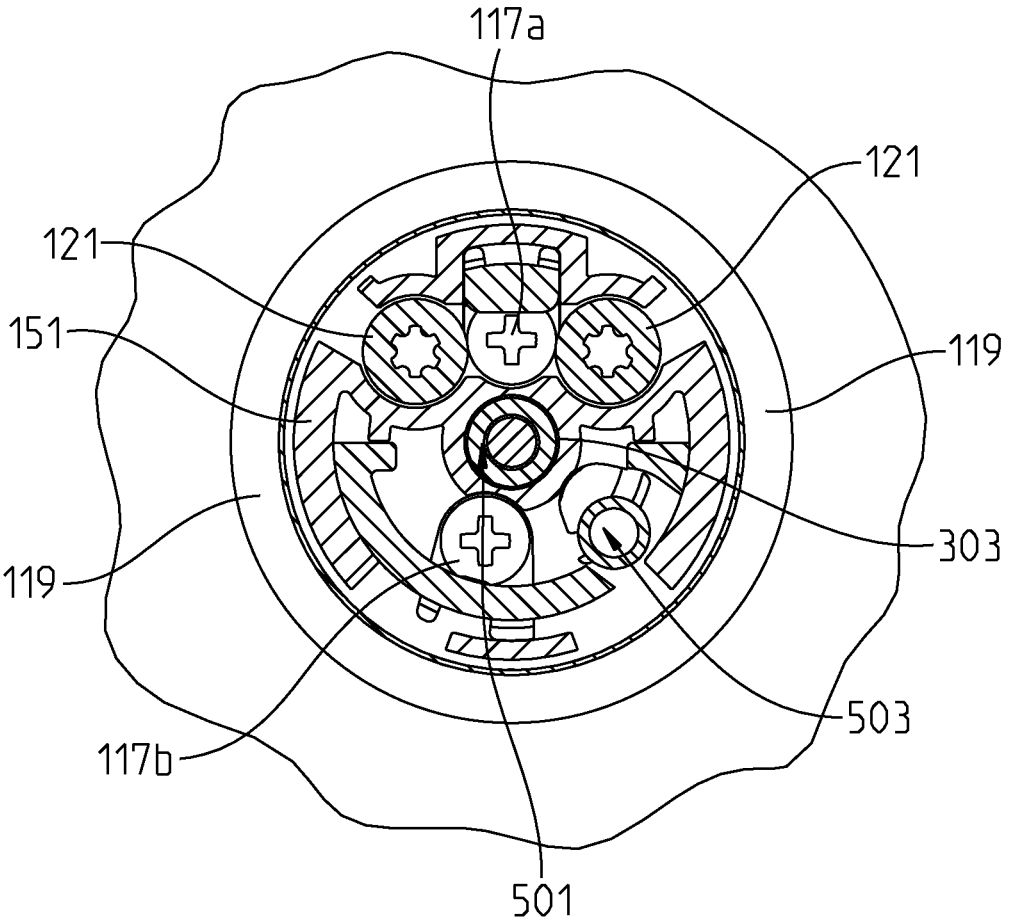
FIG. 5 is a cross-sectional view of the spout anchor taken along line 5-5 of FIG. 1.

Corresponding reference characters indicate corresponding parts throughout the several views. Unless otherwise stated, the drawings are proportional. The exemplifications set out herein illustrate exemplary embodiments of the disclosure and such exemplifications are not to be construed as limiting the scope of the disclosure in any manner.

DETAILED DESCRIPTION OF THE DRAWINGS

The embodiments described herein are not intended to be exhaustive or to limit the disclosure to precise forms disclosed. Rather, the embodiments selected for description have been chosen to enable one skilled in the art to practice the disclosure.

With reference to FIG. 1, a widespread faucet system 100 is shown coupled to a mounting deck 111. The widespread faucet 100 includes a delivery spout 102 and two valves 104 that are coupled to the mounting deck 111 by anchors 151 and 153. Generally, the anchors 151 and 153 are supported by a mounting deck 111, typically a countertop or sink deck having one or more access openings, and the delivery spout 102 and the two valves 104 are supported by the anchors 151 and 153. Liquid, for example water, from at least one source, for example hot and cold water sources, enters each of the valves 104 via a water inlet conduit (shown as 119*a* and 119*b*). The valve controls the flow of the liquid to return conduit (shown as 120*a* and 120*b*) associated with each of the valves 104. Handles 101 may, in an embodiment, manipulate the valves 104 to control the flow of liquid. Exemplary embodiments of valve assemblies may be found in U.S. Patent Publication No. 2011/0094604, titled "VALVE ASSEMBLY FOR A TWO HANDLE FAUCET," incorporated herein by reference. The valves 104 control the rate of liquid flowing from cold and hot water inlet conduits 119*a* and 119*b*, of the waterway assembly to return conduits 120*a* and 120*b*. The return conduits 120*a* and 120*b* from the two valves are joined to mix the liquids from the return conduits, and the combined mixture of liquids flows in the combined return conduit 122 through the delivery spout 102. The waterway assembly may be of conventional design, and illustratively of the type disclosed in U.S. patent application Ser. No. 11/700,634, filed Jan. 31, 2007, entitled "FAUCET INCLUDING A MOLDED WATERWAY ASSEMBLY," incorporated by reference herein.

Each of the inlets 119*a* and 119*b* illustratively includes an end connector (not shown) configured to couple to a fluid coupling for supplying water from hot and cold water sources (not shown). The fluid couplings may comprise a quick release coupling, such as PMC Series couplings available from Colder Products Company of St. Paul, Minn. Other conventional fluid couplings may be substituted therefor, such as those detailed in U.S. Pat. No. 6,672,628.

Illustratively, the inlets 119*a* and 119*b* are formed of a flexible material to facilitate positioning of the respective end connectors (not shown) relative to the faucet assembly 101. In one illustrative embodiment, the inlets 119*a* and 119*b* and return conduit 120*a* and 120*b* are all formed of cross-linked polyethylene (PEX).

With reference to FIGS. 1-10, each of the anchors 151 and 153 operate similarly to mount the anchor to the mounting deck 111, and are described with similar reference numbers. The shape of the anchors 151 and 153 may be different to accommodate the fluid conduits carried therein. Similarly, the sizes of the cleats 117*a* and 117*b* may be different between anchors 151 and 153 to accommodate different forces present when mounting either the valves 104 or the delivery spout 102, or the forces required to keep the valves 104 or the delivery spout 102 stable during operation.

The anchors 151 and 153 illustratively include an anchor floor portion which is mounted from the top of the mounting deck 111 and rests on the upper surface 129 thereof. It should be noted that the anchors 151 and 153 may also be mounted from the underside of the mounting deck 111 below its lower surface. The anchors 151 and 153 may include a void to receive the waterway assembly, including the inlets 119*a* and 119*b*, the return conduits 120*a* and 120*b*, and/or the combined return conduit 122. First and second attachment posts 217*a* and 217*b* extend downwardly from the anchors 151 and 153. The attachment posts 217*a* and 217*b* each include a plurality of external threads and are configured to operably couple with the cleats 117*a* and 117*b*. An upper end of each post 217*a* and 217*b* extends through the anchor 115 and includes a head configured to be manipulated by a tool, such as a screwdriver or Allen wrench (not shown). Upper and lower apertures 711 and 709 receive each attachment post 217*a* and 217*b*, respectively. The upper apertures 711 and the lower apertures 709 are formed within the anchor 115. Further, the anchor includes grooves 133 (shown for attachment post 217*a*, not shown for attachment post 217*b*) for each of the attachment posts 217*a* and 217*b*. Grooves 133 are configured to receive the respective attachment post 217*a* and 217*b* and guide the respective cleats 117*a* and 117*b* in movement longitudinally therealong. In one illustrative embodiment, the anchors are formed, for example, through molding of a thermoplastic material.

The mounting plate cleats 117*a* and 117*b* each include a threaded opening configured to threadably engage the respective attachment post 217*a* and 217*b*. Each cleat 117*a* and 117*b* is substantially wedge shaped and includes an upper surface 703 configured to cooperate with the anchor floor portion 219 to clamp the anchor 115 to the mounting deck 111. When the anchor 115 is positioned on the mounting deck 111, the threaded attachment posts 217*a* and 217*b* are rotated to cause the mounting plate cleats 117*a* and 117*b* to move longitudinally up and down on the posts 217*a* and 217*b*, respectively. Illustratively, counterclockwise rotation of attachment posts 217*a* and 217*b* causes cleats 117*a* and 117*b* to move downwardly or away from mounting deck 111 to an unlocked position. The cleats 117*a* and 117*b* may be directed inside of the anchor 115, in a respective support structure (shown as 705 for cleat 117*a*, not shown for cleat 117*b*). The shape of the support structures 705 conform to the cross-sectional shape of cleats 117*a* and 117*b*

Clockwise rotation of attachment posts 217*a* and 217*b* causes cleats 117*a* and 117*b* to move upwardly or toward mounting deck 111 to a locked position. In the locked position, the upper surfaces 703 of the cleats 117*a* and 117*b* abuts the bottom or lower surface 127 of mounting deck 111, securing the anchor 115 thereto.

The cleats 117*a* and 117*b* are prevented from rotating with the attachment posts 217*a* and 217*b* as they are turned, by guide surfaces of each cleat 117*a* and 117*b*. The guide surfaces abut against cooperating stop surfaces of the grooves 133, upon rotation of the cleats 117*a* and 117*b*, respectively. This causes cleats 117*a* and 117*b* to ride up or down the attachment posts 217*a* and 217*b* within the grooves 133 as they are rotated instead of rotating 360 degrees with the rotation of the posts 217*a* and 217*b*. As noted above, attachment posts 217*a* and 217*b* are stabilized and secured at their bottom portions by the anchor 115 body.

Figure 6:
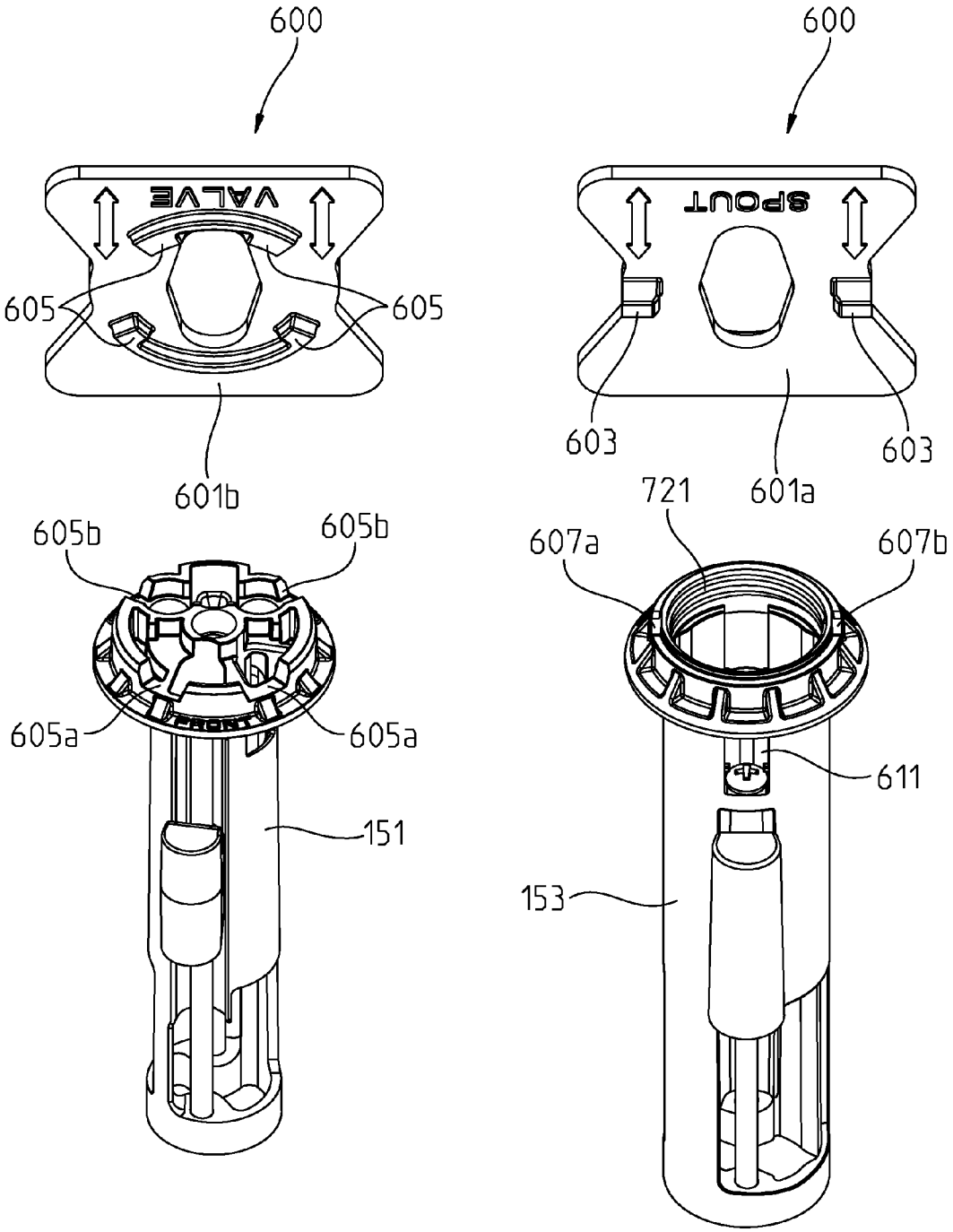
FIG. 6 is a top perspective view of the spout anchor and the valve assembly anchor of FIG. 1.
Figure 7:
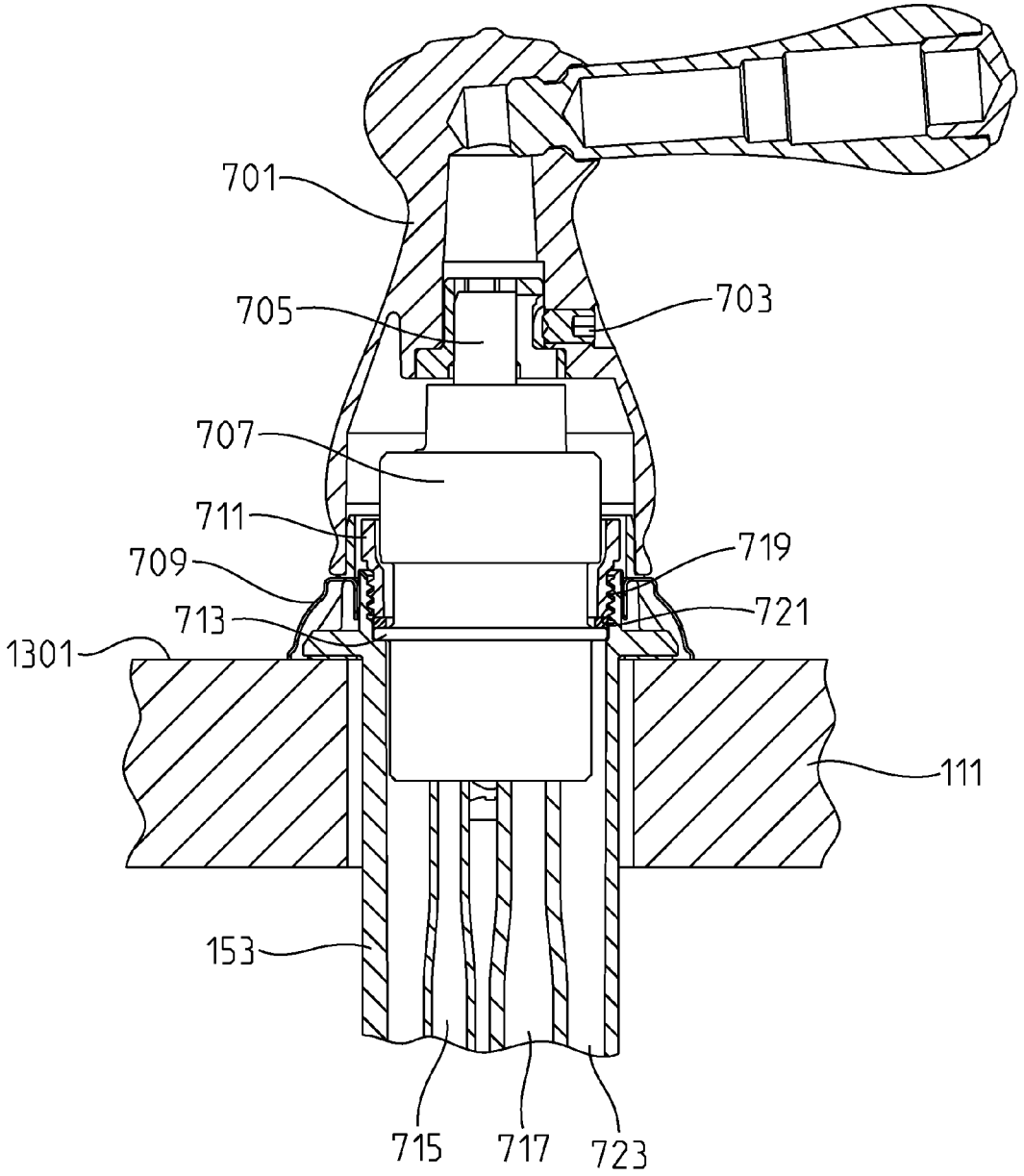
FIG. 7 is a cross-sectional view of the valve assembly taken along line 7-7 of FIG. 1.

Shown in FIG. 6, the anchors may be properly positioned on mounting deck 111 using one or more positioning tools 600. The positioning tool 600 may include one or more projections 603 and 605 that interact with complimentary projections on the upper surface of the anchors 151 and 153, and allow the positioning tool 600 to be installed on the upper surface of the anchors 151 and 153 in one orientation. For example, projections 605 on the first surface 601*b* of the positioning tool 600 may interact with projections or indentations 605*a* and 605*b* on the delivery spout anchor 151. On the reverse side or second surface 601*a* of the positioning tool 600, projections 603 may interact with projections or indentations 607*a* and 607*b* on the valve anchor 153. During installation, the anchor 151 and 153 is positioned in the void in the mounting deck 111, and the positioning tool 600 is placed on the top of the anchor 151 and 153, so that the projections of the mounting tool 600 interact with the projections of the anchor 151 and 153. The anchor 151 and 153 and mounting tool 600 are then rotated so that the anchor 151 and 153 is oriented correctly in the opening in the mounting deck 111. For example, the mounting tool 600 may be used to position the anchor 151 and 153 to an orientation that allows the delivery spout 102, when subsequently mounted, to face in a specific direction. More than one mounting tool 600 may be used, one for the delivery spout anchor 151 and another for the valve anchors 153, or a single mounting tool may be used with one side 601*b* of the tool used for the delivery spout 151 anchor and the other side 601*a* of the tool used for the valve anchors 153. The positioning tool 600, in the embodiment, is removed before installation of the spout or valve assemblies.

The anchor 153 and the handle 701 for a valve assembly 104 are described with reference to FIGS. 7-10B. The valve assembly 104 receives liquid from an inlet conduit 715 and allows the liquid to flow through a valve to an outlet conduit 717 depending on the position of a valve stem 705. The handle 701 is positioned on or above the upper surface of the mounting deck 111, and the inlet conduit 715 and outlet conduit 717 are positioned below the lower surface of the mounting deck 111.

The anchor 153, in an embodiment, includes the general features described above, and also includes a trim ring 709. The trim ring 709 is attached to the upper portion 401 of the anchor 153 that extends above the upper surface of the mounting deck 111, and hides the anchor 153 from view from the upper surface of the mounting deck 111. The trim ring 709 is positioned on the anchor 153 so that, on installation, the trim ring 709 abuts or is a short distance from the upper surface 1301 of the mounting deck 111. The handle anchor 153 also includes internal threads 721 configured to engage with external threads 719 of the locking ring 711, explained in more detail below. The anchor 153 may also include a foam or elastomeric gasket 315 to seal the anchor to the mounting deck 111. The gasket 315 may be held in place with a groove (not shown) disposed in the anchor 153, or the gasket 315 may be releasably attached to the anchor 153 with, for example, an adhesive.

The valve cartridge 707 includes a valve, a valve stem 705 to manipulate the valve, an inlet conduit 715, and an outlet conduit 717. Liquid from one or more sources enters the valve via the inlet conduit 715. The amount of liquid entering the outlet conduit 717 is dependent on the position of the valve stem 705. Rotation of the valve stem 705 increases or decreases the amount of liquid entering the outlet conduit 717.

The valve cartridge 707 also includes a locking ring 711 located on the outer surface of the valve cartridge 707. The locking ring 711 is captured by one or more projections 803 on the valve cartridge 707, so that the locking ring 711 may freely rotate around the valve cartridge 707, but the projections 803 prevent the locking ring 711 from substantially moving along the longitudinal axis of the valve cartridge 707. The locking ring 711 is substantially cylindrical, and includes external threads 719. The locking ring 711 also includes projections or indentations 805, shown with respect to FIGS. 8 and 9, to allow a tool 1001, shown in FIGS. 10A and 10B, to engage and rotate the locking ring 711.

Figure 8:
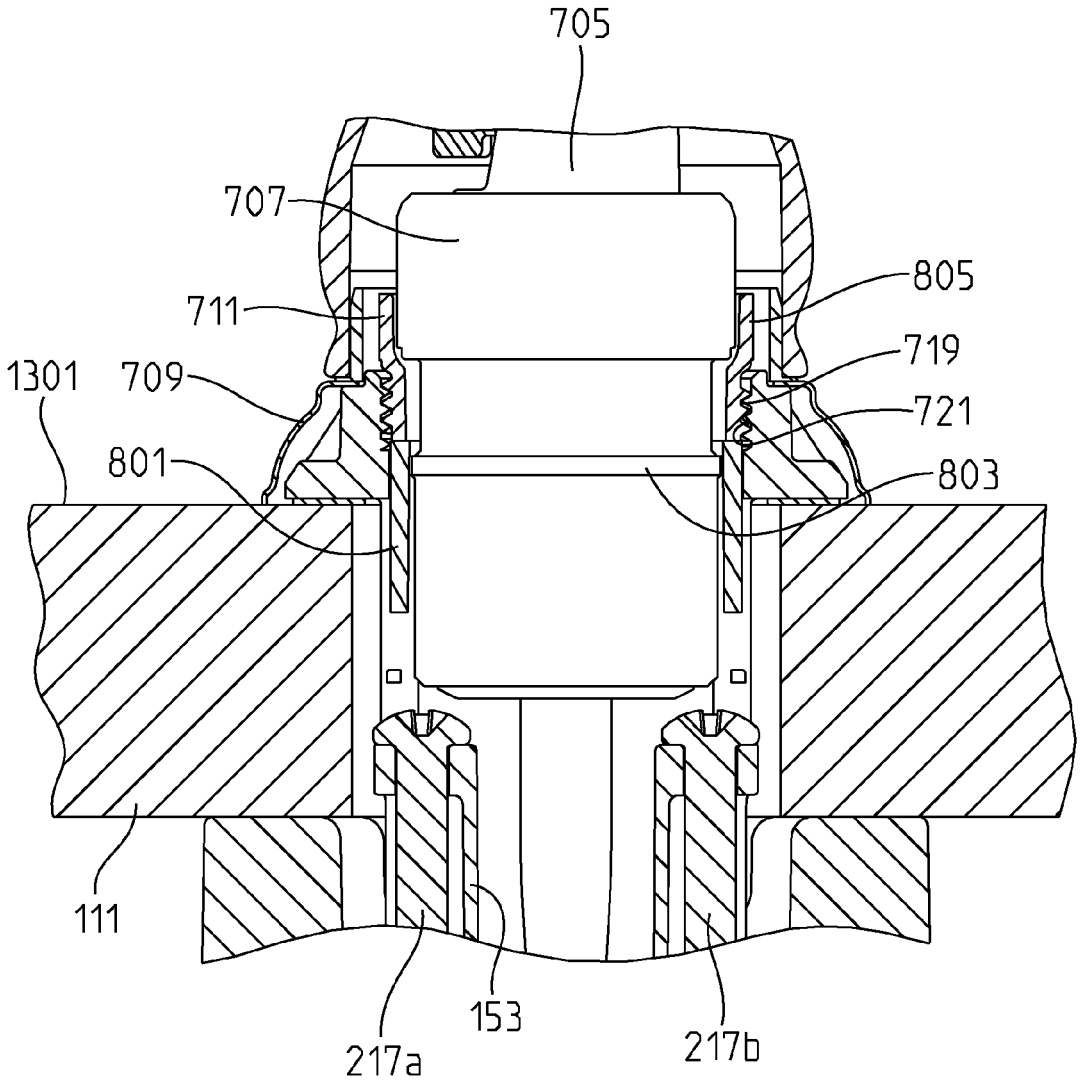
FIG. 8 is a detailed view of the valve assembly of FIG. 7.
Figure 9:
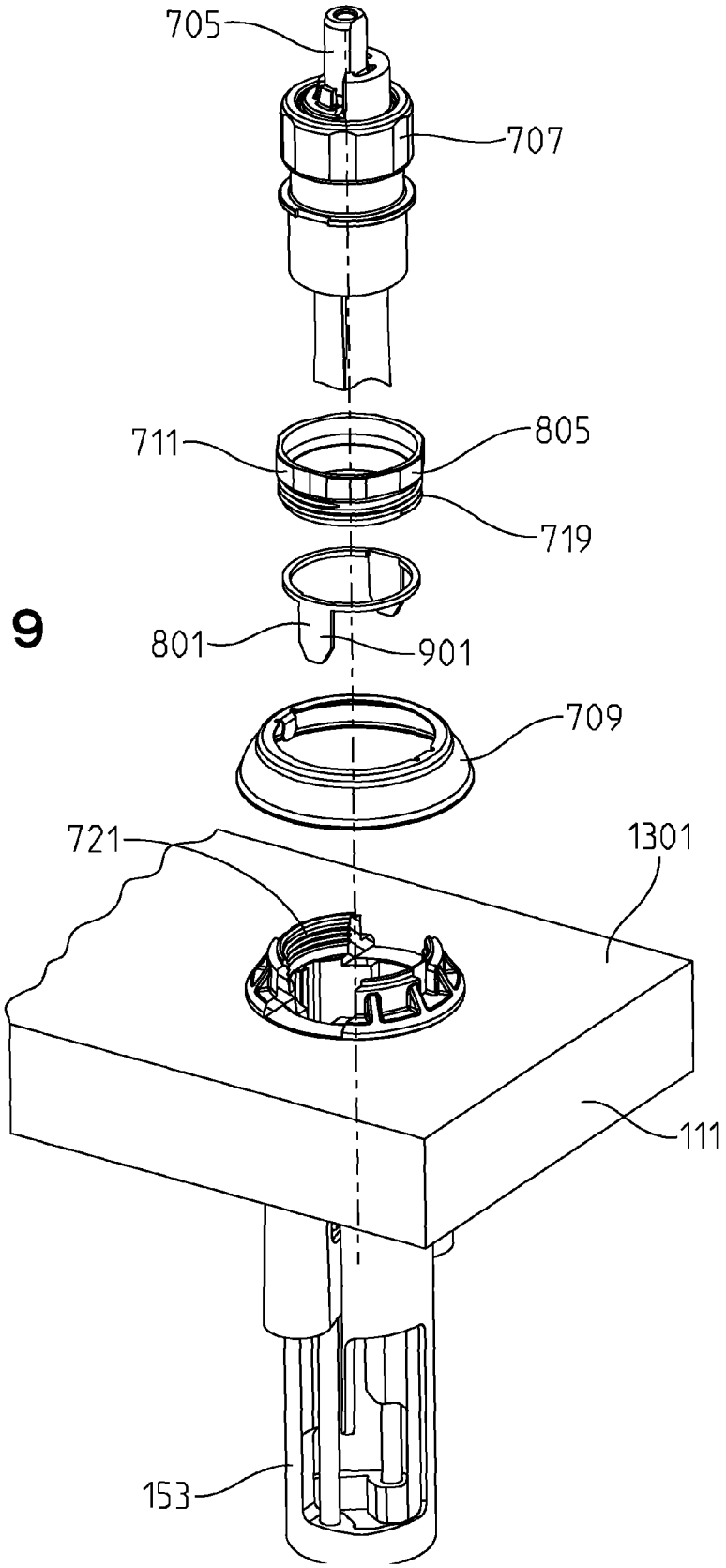
FIG. 9 is an exploded perspective view of the valve assembly of FIG. 1.

The valve cartridge 707 also includes an orientation ring 801, shown particularly in FIGS. 8 and 9. The orientation ring 801 is substantially cylindrical and surrounds the valve cartridge 707. The orientation ring 801 is constrained from rotation and movement along the cylindrical axis of the valve cartridge 707 by one or more projections 803 on the valve cartridge 707. In an embodiment, the orientation ring 801 may instead be one or more projections located on the outer surface of the valve cartridge 707. The orientation ring 801 includes one or more projections or indentations 901 that engage or cooperate with complimentary voids 611 or recesses, shown in FIG. 6, within the void of the anchor 153, limiting the installation of the valve cartridge 707 within the anchor 153 to a specific angular orientation. The orientation allows for the handles 701 of the valve assembly 104, when installed with the complimentary valve cartridge 707, to be positioned symmetrically to one another.

The handle 701 may be a metal or plastic, and allows a user to manipulate the valve stem 705 to change the flow of liquid from an inlet conduit 715 to an outlet conduit 717. The projection may be a metal or plastic, and may be permanently or releasably attached to the handle 701. The handle may include internal projections or indentations to receive the valve stem 705 in one direction, and the projections or indentations may engage with complimentary projections or indentations on the valve stem 705 to allow the handle 701 to rotate the valve stem 705 to manipulate the flow of liquid in the valve. The handle may be releasably attached to the valve stem 705 via, for example, at set screw 703.

Figure 10A:
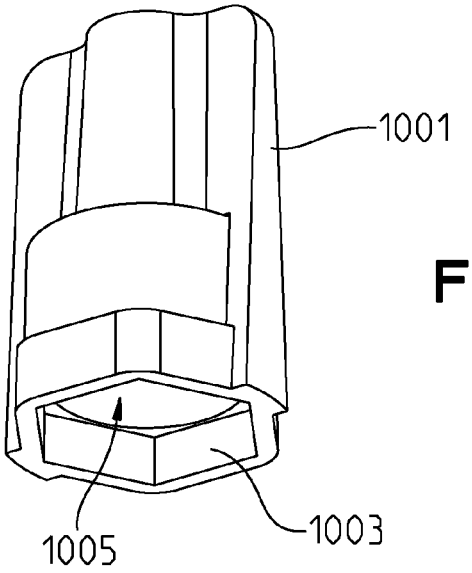
FIG. 10A is a bottom perspective view of a mounting tool according to an embodiment of the present disclosure.
Figure 10B:
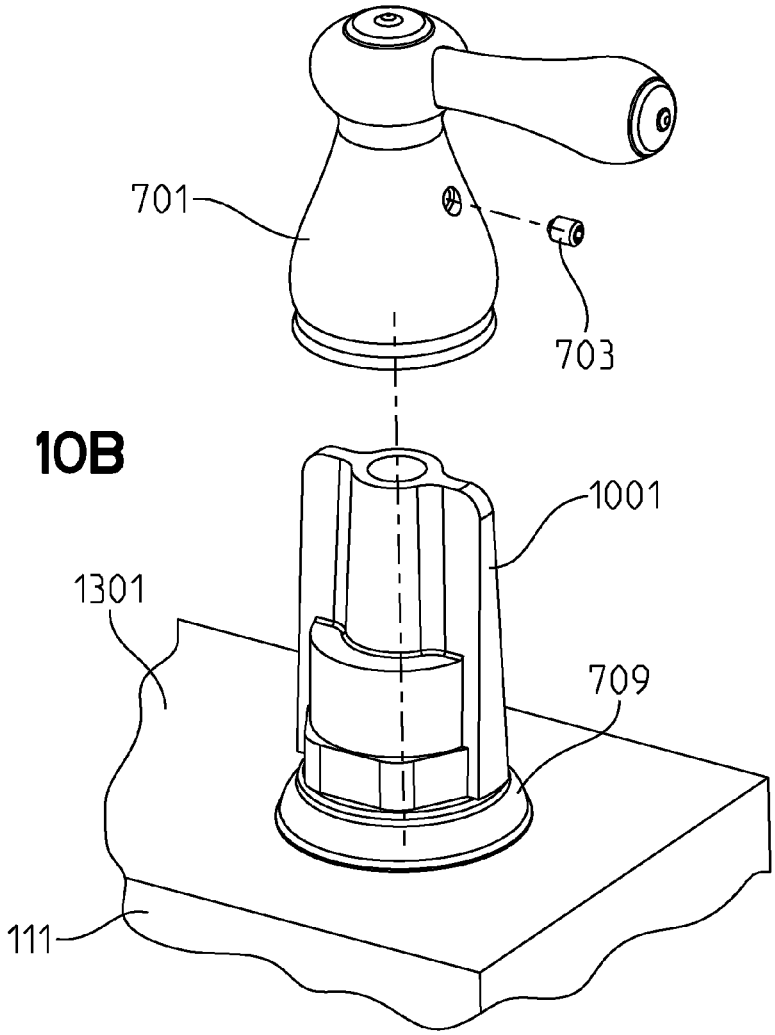
FIG. 10B is an exploded view of a valve assembly cooperating with the mounting tool of FIG. 10A.
Figure 11:
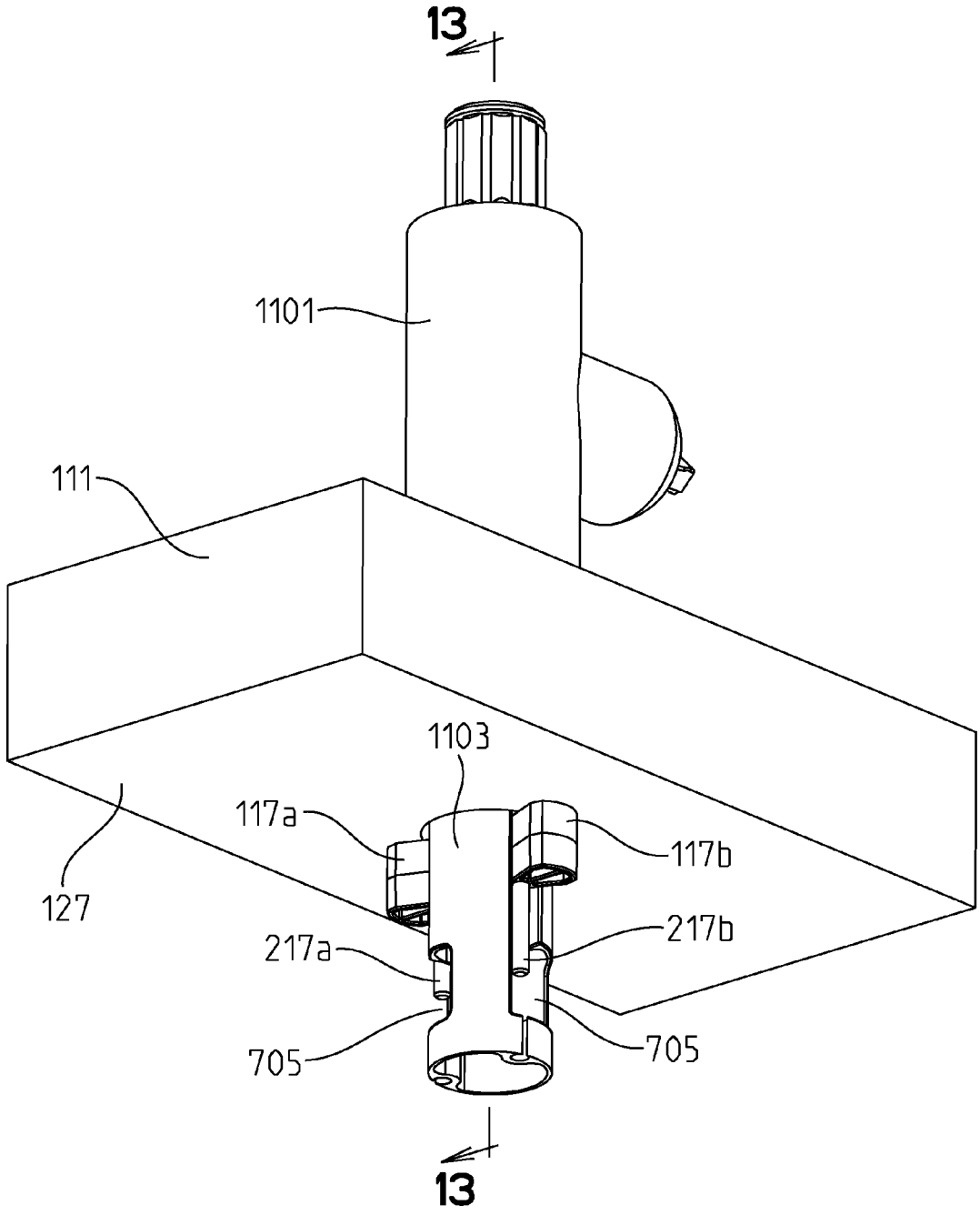
FIG. 11 is a bottom perspective view of a faucet according to another embodiment of the present disclosure.
Figure 12:
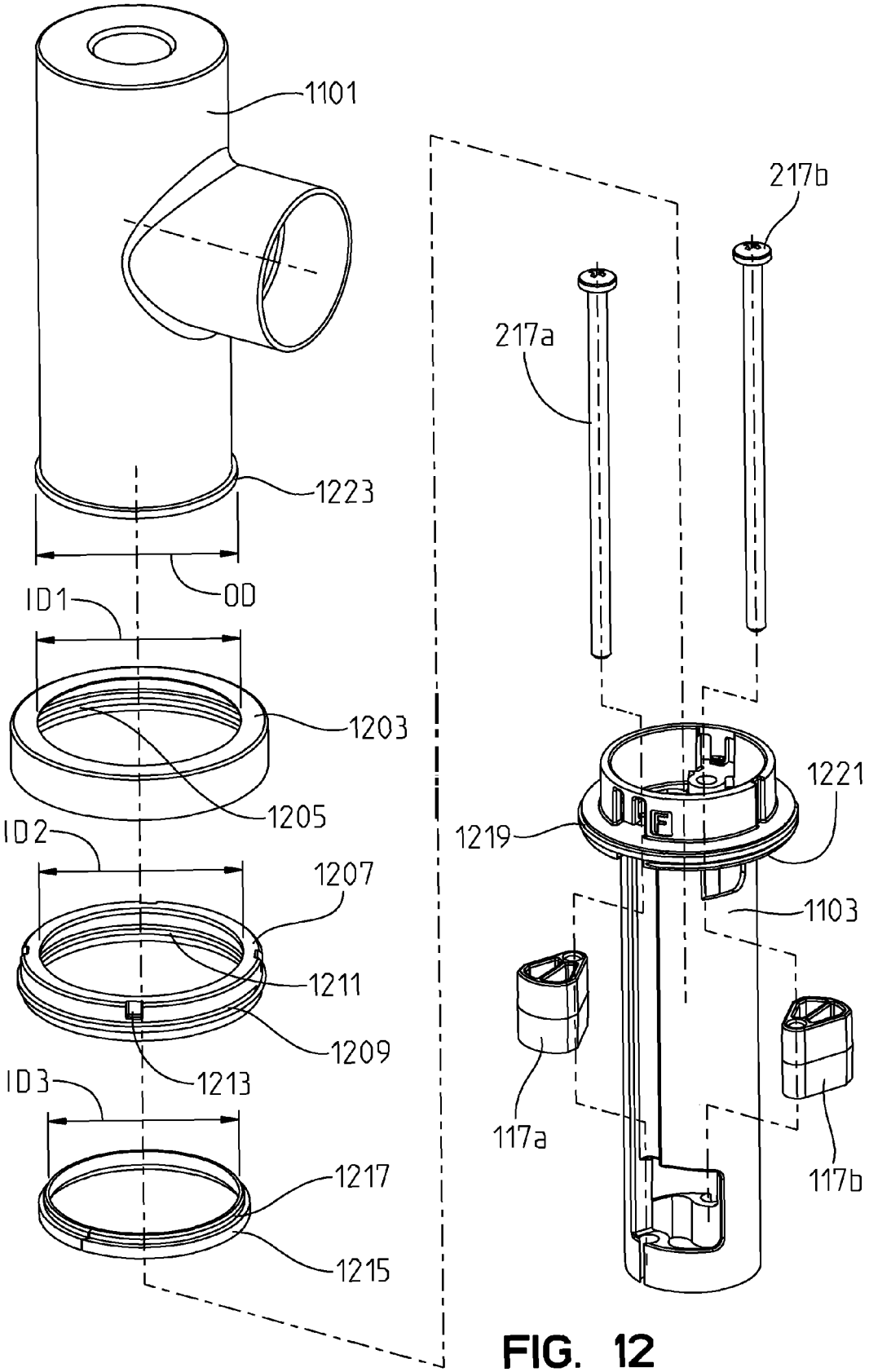
FIG. 12 is an exploded view of a faucet body and anchor of the faucet assembly of FIG. 11.
Figure 13:
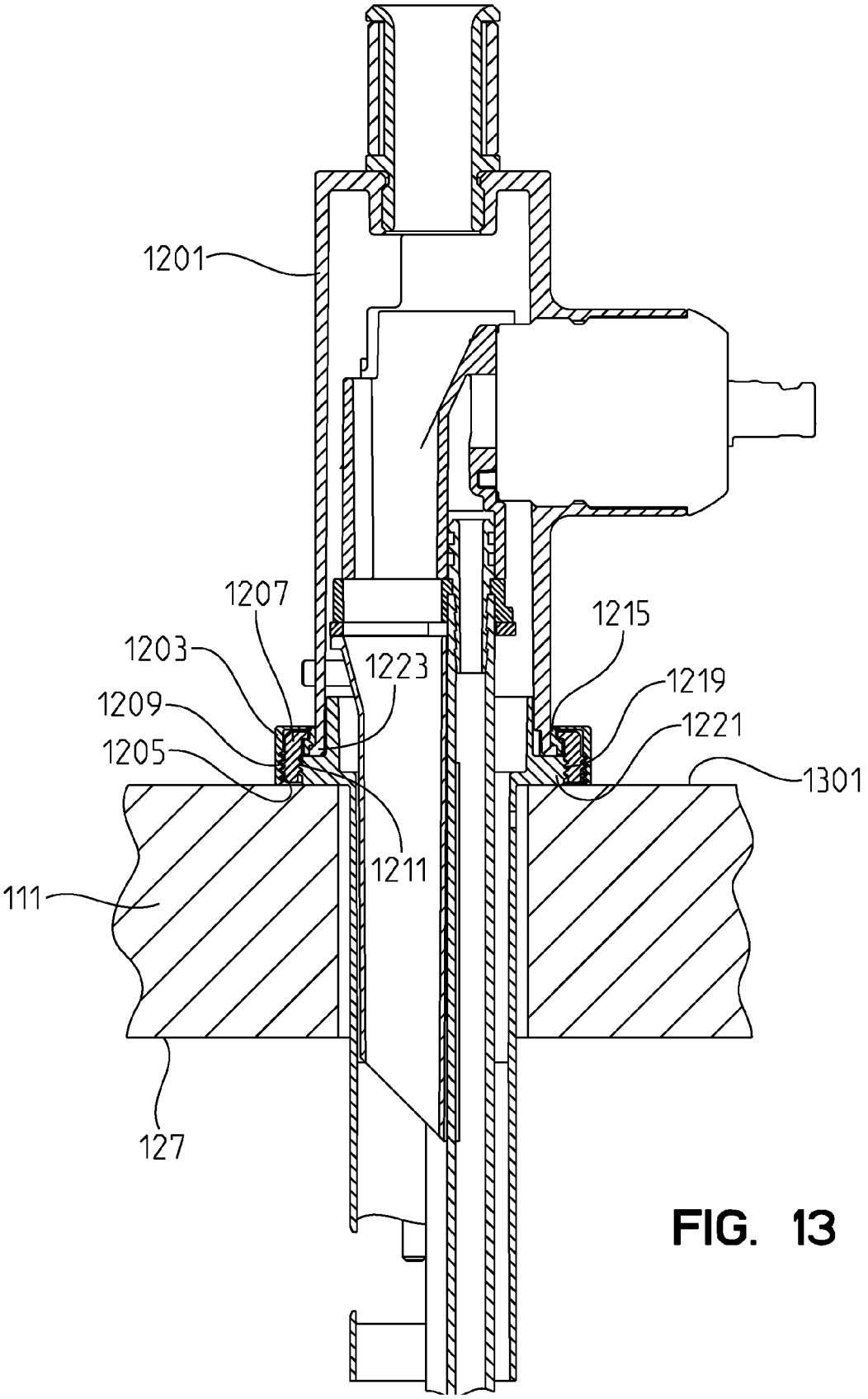
FIG. 13 is a cross-sectional view of the faucet body and anchor taken along line 13-13 of FIG. 11.
Figure 14:
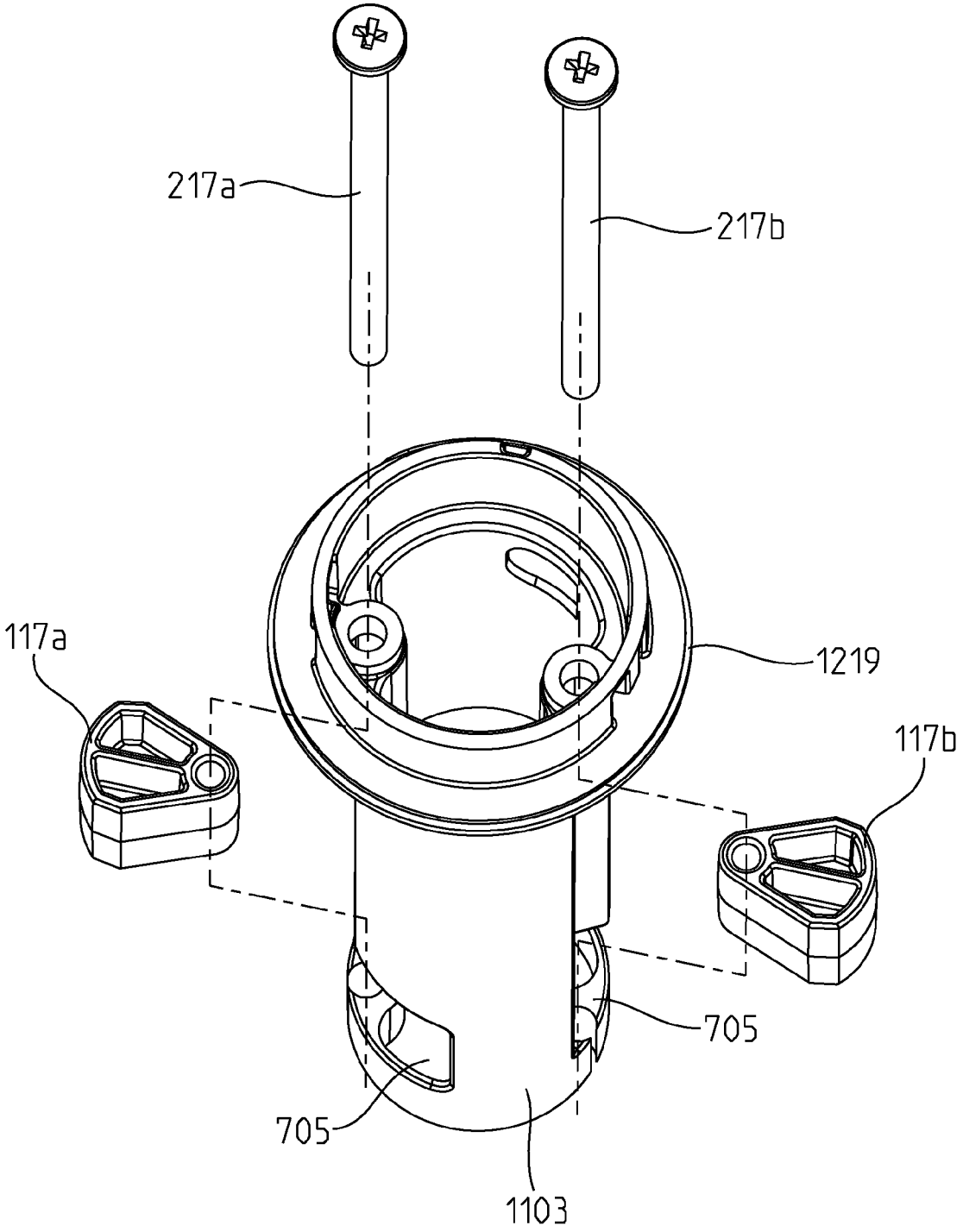
FIG. 14 is a top perspective view of the anchor of FIG. 12.

During installation, described with reference to FIGS. 9-10B, the trim ring 709 is attached to the anchor 153. The orientation ring 801 and the locking ring 711 are positioned on the valve cartridge 707. The locking ring 711 may rotate about the valve cartridge 707, but is prevented from movement along the cylindrical axis of the valve cartridge 707 by one or more projections. The orientation ring 801 is prevented from rotation and movement along the cylindrical axis by one or more projections on the valve cartridge 707. The inlet conduit 715 and outlet conduit 717 are inserted from the top of the mounting deck 111 into the anchor void 723, and are pushed through the anchor void 723 to the bottom of the mounting deck 111. The valve cartridge 707 is positioned in the anchor 153, so that the projections or indentations on the orientation ring 801 engage with complimentary projections or indentations on the inner surface of the anchor 153. The valve cartridge 707 is pushed into the anchor void 723 until the external threads 719 of the locking ring 711 engage with the internal threads 721 of the anchor 153.

The installation tool 1001 is placed over the valve cartridge 707, so that the internal structure 1003 of the installation tool 1001 engages with the projections or indentations of the locking ring 711. The installation tool 1001 may be sized so that the valve stem 705 does not interfere with the installation tool 1001, or the installation tool 1001 may include one or more voids 1005 to allow the valve stem 705 to pass into or pass through the installation tool 1001. The user rotates the installation tool 1001, which rotates the locking ring 711. The external threads 719 of the locking ring 711 engage with the internal threads 721 of the anchor 153, and pull the locking ring 711 and the valve cartridge 707 to the anchor 153. The interference of the projections on the orientation ring 801 and the projections on the inner surface of the anchor 153 prevents the valve cartridge 707 from rotating within the anchor 153. When the locking ring 711 is tightened against the anchor 153, the installation tool 1001 is removed. The handle 701 is positioned over the valve cartridge 707, so that the handle 701 interacts with the valve stem 705, and a set screw 703 is installed into the handle 701 to hold the handle 701 in place.

The spout assembly 102 includes a spout 103 having a first opening 109 and a second opening 107. The outlet conduits of the valve assemblies join under the mounting deck into a combined outlet conduit 122. The combined outlet conduit 122 enters the anchor 151, extends through the mounting deck 111, enters the first opening 109 of the spout 103, extends through the spout 103, and exits the second opening 107 of the spout 103. The second opening 107 of the spout 103 may include, in an embodiment, an aerator or other structure to modify the flow of liquid from the combined outlet conduit 122. The faucet assembly 102 also includes a retaining structure 115 to hold a bushing 113 in place within the faucet assembly 102. The spout 103 also includes a third opening. The third opening allows the installation tool 1001 or the lift rod 123 to extend from above the spout 103 to the inner area of the spout 103.

The retaining structure 115, in the embodiment, includes two screws 121 to releasably attach the retaining structure 115 to the spout 103. The retaining structure 115 includes one or more projections to hold the bushing 113 within the spout 103, and also a void 307 to hold the bushing 113 and allow the void 309 of the bushing 113 to extend from the inner area 219 of the spout 103 through the first opening 109 of the spout 103. The projections allow the bushing 113 to rotate freely, and also allow for limited movement of the bushing 113 along the bushing's cylindrical axis, but prevent the bushing 113 from removal from the spout 103 or removal from the retaining structure 115. The retaining structure 115 also includes a void (not shown) to allow the combined outlet conduit 122 to pass from the inner area of the spout 103 through the first opening 109 of the spout 103 and into the anchor 151.

The bushing 113, in the embodiment, is a metal or plastic. The bushing 113 is substantially cylindrical and includes a first end 313 and a second end 315, and has a void 309 with a first diameter that extends from the first end 311 to the second end 313. The void 309 at the first end 311 has a larger diameter than the void at the second end 313. The walls 201 at the void 309 at the first end 311 allow engagement of an installation tool 1001 to facilitate rotation of the bushing 113. The void 309 of the bushing 113 allows the lift rod 123 to pass through the void 309 without substantial interference. The installation tool 1001 has a diameter larger than the diameter of the lift rod 123, and the walls 201 of the void 309 at the first end 311 interfere with the installation tool 1001, allowing the installation tool 1001 to rotate the bushing 113. The bushing 113 includes threads 301 on the outer surface at the second end 313.

In the embodiment, the anchor 151 includes the general structure as described above. The anchor 151 also includes a first void 503 and a second void 501, shown with respect to FIG. 5. The first void 503 and the second void 501 extend through the anchor 151, so that when the anchor 151 is installed in the mounting deck 111, the voids 501 and 503 extend from the upper surface 1301 of the mounting deck 111 to the lower surface 127 of the mounting deck 111. The first void 503 allows for the combined outlet conduit to pass through the mounting deck 111. The second void 501 includes threads 303 on the inner surface. The threads 303 on the inner surface engage with external threads 301 located on the bushing 113. In an embodiment, the first void 503 and the second void 501 combine into a single void at or near the lower surface of the mounting deck 111. In another embodiment, the first void 503 and the second void 501 combine into a single void near the upper surface of the mounting deck 111. The trim ring 119 is attached to the portion of the anchor 115 that extends above the upper surface 1301 of the mounting deck 111, and hides the anchor 115 from view from the upper surface 1301 of the mounting deck 111. The trim ring 119 is positioned on the anchor 115 so that, on installation, the trim ring 119 abuts or is a short distance from the upper surface 1301 of the mounting deck 111.

During installation, the faucet assembly 102 is placed over the anchor 115. The combined outlet conduit enters the first void 503 of the anchor 115 and extends through the anchor 115 and below the mounting deck 111. The faucet assembly 102 is placed over the anchor 115, and the projections or indentations on the faucet assembly 102 engage with the projections or indentations on the anchor 115 so that the faucet assembly 102 may be oriented in only one orientation with respect to the anchor 115. When the projections or indentations on the faucet assembly 102 and the anchor cooperate and the faucet assembly 102 is moved close to the assembly, the threads 301 of the bushing 113 align with the anchor threads 303.

The lift rod 123, which may include an end cap 105 or other decorative or functional cap, may be removed from the faucet assembly 102, or may have been removed before the faucet assembly 102 is positioned over the anchor 115, and the installation tool 1002 is placed into the opening in the faucet assembly 102 for the lift rod 123. The spout installation tool 1002 is lowered into the faucet assembly 102, and engages the walls 201 at the void 309 at the first end 311 of the bushing 113. Rotation of the spout installation tool 1002 rotates the bushing 113, and the external threads 301 of the bushing 113 engage the anchor threads 303. Rotation of the spout installation tool 1002 forces the faucet assembly 102 onto the anchor 115. The projections of the faucet assembly 102 and the projections of the anchor cooperate to prevent substantial rotation of the faucet assembly 102, and the engagement of the external threads 301 of the bushing 113 and the anchor threads 303 prevents movement perpendicular to the mounting deck 111. The spout installation tool 1002 is removed from the faucet assembly 102, and the lift rod 123 is replaced in the faucet assembly 102. The lift rod 123 extends through the spout 103, through the bushing 113, through the anchor 115 via the second void 501 in the anchor, and below the lower surface of the mounting deck 111. The combined outlet conduit 122 is attached to the outlet conduits 120*a* and 120*b* from the valve assemblies.

In a further embodiment, shown in FIGS. 11-16, a delivery spout 1101 may also include a valve that allows the flow of fluid from one or more sources, such as a hot and cold water source (not shown) to be adjusted and to mix in a return conduit (not shown). The delivery spout 1101 is in communication with the mounting deck 111 via an anchor 1103. A locking ring 1207 and a retaining ring 1215 may cooperate with the delivery spout 1101 and the anchor 1103 to releasably fix the delivery spout 1101 to the anchor 1103. In an embodiment, the anchor 1103 includes external threads 1219 which engage with threads of the locking ring 1207. In an embodiment, a trim ring 1203 is positioned over the locking ring 1207, to hide the locking ring 1207 and other components from view after installation. The anchor 1103 and the delivery spout 1101, in the embodiment, are installed from the top of the mounting deck 111, with liquid connections made below the mounting deck 111.

The anchor structure 1103 may be similar to the anchor structure 113 previously shown with respect to anchors 151 and 153, however the anchor 1103 may provide external threads 1219 to releasably secure the faucet body or delivery spout 1101 to the anchor 1103. The anchor 1103 cleats 117*a* and 117*b* may releasably engage the bottom surface 127 of the mounting deck 111, and the top surface 1221 of the anchor 1103 may engage the top surface 1301 of the mounting deck 111, so that the anchor 1103 is releasably engaged with the mounting deck 111. The threads 1219 of the anchor 1103 may be used to releasably secure the delivery spout 1101 to the anchor 1103, and thus to the mounting deck 111, as more fully explained below.

Figure 15:
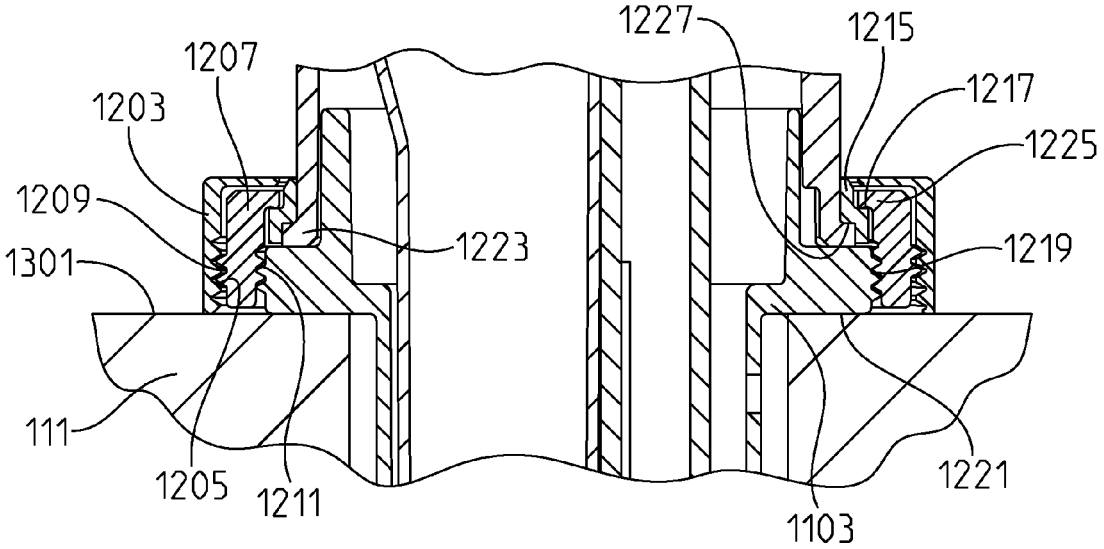
FIG. 15 is a detailed cross-sectional view of a faucet body mounted to a mounting deck of FIG. 13.

In one embodiment, shown in FIG. 15, a decorative or trim ring 1203, a locking ring 1207, and a retaining ring 1215 are shown along with the anchor 1103 and the delivery spout 1101. The locking ring 1203 is positioned around the delivery spout 1101, and the retaining ring 1215 holds the locking ring 1203 around the delivery spout 1101. When the locking ring 1203 inner surface threads 1211 are engaged with the threads 1219 of the anchor 1103, the locking ring 1203 presses against the retaining ring 1215, which forces the delivery spout 1101 towards the mounting deck 111.

The trim ring 1203 may be a metal or plastic ring, which may be substantially circular. The trim ring 1203 may include internal threads 1205 on the inner surface of the trim ring 1203. The trim ring 1203 may be sized so that the inner diameter (ID1) is larger than the outer diameter (OD) of the delivery spout 1101. The bottom surface of the trim ring 1203 may abut the installation deck 111 upon installation, or the bottom surface of the trim ring 1203 may interact with a gasket or other structure supported by the mounting deck 111. The top inner surface of the trim ring 1203 may also include a gasket disposed therein. The gasket or gaskets may seal the inner surface of the trim ring 1203 to the remaining structure, and may keep moisture and/or debris confined to the outside of the trim ring 1203.

The locking ring 1207 may be a plastic ring, which may be substantially circular. The locking ring 1207 may be sized so that the inner diameter (ID2) is larger than the outer diameter (OD) of the delivery spout 1101. The locking ring 1207 may include inner surface threads 1211 and outer surface threads 1209. The inner surface threads 1211 may engage the complimentary external threads 1219 on the anchor 1103, and the outer surface threads 1209 may engage the complimentary internal threads 1205 on the trim ring 1203. The locking ring 1207 may include one or more structures 1213, either projections or indentations, that may allow a tool (not shown) to engage the structures 1213 to rotate the locking ring 1207.

The retaining ring 1215 may be a plastic ring, which may be substantially circular, but which may not be continuous (i.e., split, in that the retaining ring 1215 may be broken in one or more places). The retaining ring 1215 may be sized so that the retaining ring 1215 may be opened and the diameter of the opened ring may be larger than the outer diameter (OD) of the delivery spout 1101, but that when the retaining ring 1215 is closed (i.e., when the broken ends of the retaining ring 1215 are in communication or are closer together than when the ring is in the open position), the diameter of the inner surface (ID3) of the retaining ring 1215 is smaller than the outer diameter (OD) of the lip 1223 of the delivery spout 1101, and so the retaining ring 1215 rests on the lip 1223 of the delivery spout 1101. When the retaining ring 1215 rests on the delivery spout 1101, the retaining ring 1215 may extend the effective diameter of the delivery spout 1101, and the increased diameter may be greater than the internal diameter of both the trim ring 1203 and the locking ring 1207. If the locking ring 1207 and the trim ring 1203 are installed around the delivery spout 1101, and then the retaining ring 1215 is installed around the delivery spout 1101, then the retaining ring 1215 and the trim ring 1203 may not be able to be removed from the delivery spout 1101, without first removing the retaining ring 1215.

During installation of the delivery spout 1101, the trim ring 1203 and the locking ring 1207 are positioned on the delivery spout 1101. The trim ring 1203 and the locking ring 1207 have a diameter that is larger than the diameter of the delivery spout 1101, so that the trim ring 1203 and the locking ring 1207 may be positioned on the delivery spout 1101. The retaining ring 1215 may then be positioned on the delivery spout 1101. The retaining ring 1215 may be substantially circular but may not be continuous. The inner surface of the retaining ring 1215 may be sized so that the retaining ring 1215 may rest on the lip 1223 of the delivery spout 1101, and may functionally extend the surface of the lip 1223 of the delivery spout 1101. The delivery spout 1101 is positioned over the anchor 1103, so that the sleeve 209 and the inlets (not shown) and the return (not shown) are positioned within the anchor 1103.

Figure 16:
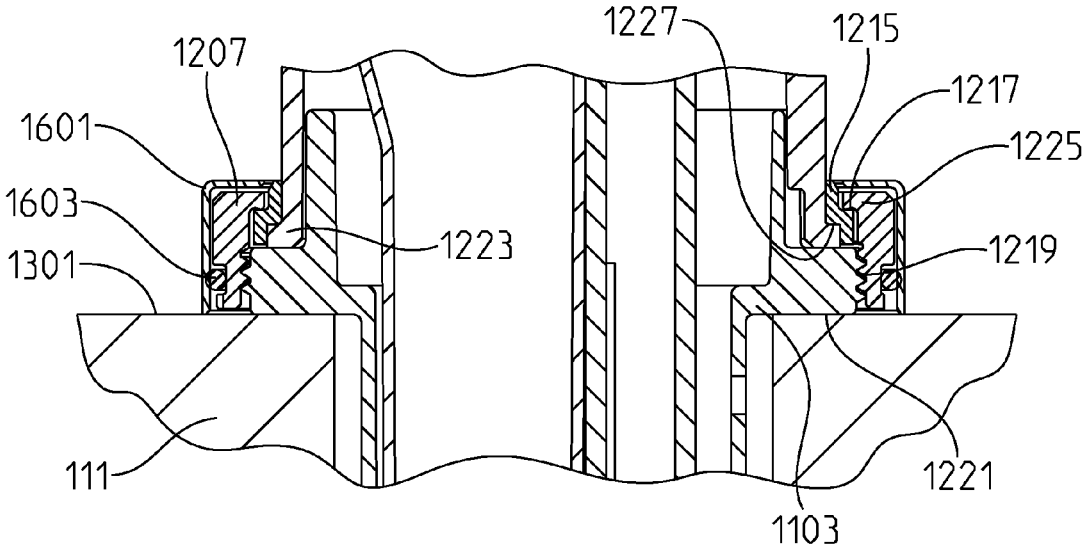
FIG. 16 is a detailed cross-sectional view similar to FIG. 15, showing another embodiment of a faucet body mounted to a mounting deck.

The inner threads 1211 of the locking ring 1207 engage with the threads 1219 of the anchor 1103. The top surface 1225 of the locking ring 1207 may abut the outer surface 1217 of the retaining ring 1215, and the inner surface 1227 of the retaining ring 1215 may abut the lip 1223 of the delivery spout 1101. The engagement of the inner threads 1211 of the locking ring 1207 and the threads 1219 of the anchor 1103 may thus force the delivery spout 1101 to the anchor 1103. The locking ring 1207 may not abut the mounting deck 111, so that the locking ring 1207 may be tightened to ensure a seal between the delivery spout 1101 and the anchor 1103. After the locking ring 1207 is tightened to the anchor 1103, the trim ring 1203 may be lowered onto the locking ring 1207, and the threads 1205 of the trim ring 1203 may engage the outer threads 1209 of the locking ring 1207. The bottom surface of the trim ring 1203 may abut the mounting deck 111. In another embodiment, and as shown in FIG. 16, the trim ring 1203 may not have threads, and the locking ring 1207 may not have external threads. In the embodiment, a deformable gasket may be disposed between the inner surface of the trim ring 1203 and the outer surface of the locking ring 1207. The trim ring 1203 may be releasably engaged with the locking ring 1207 with the deformable gasket disposed between the trim ring 1203 and the locking ring 1207.

Although the disclosure has been described in detail with reference to certain preferred embodiments, variations and modifications exist within the spirit and scope of the invention as described and defined in the following claims.

The invention claimed is:

1. A faucet assembly comprising:

a spout anchor including a spout anchor body having an upper portion configured to be supported above an upper surface of a mounting deck, and a lower portion configured to extend below the mounting deck, the upper portion having a first set of spout anchor threads;

a valve anchor including an anchor body having an upper portion configured to be supported above the upper surface of the mounting deck, and a lower portion configured to extend below the mounting deck, the upper portion having a first set of valve anchor threads;

a spout assembly including a spout body, a bushing having a first end with a recessed portion positioned internal of an external surface of the bushing and a second end with threads disposed on an external surface, an opening in the bushing extending from the recessed portion to the second end, a retaining structure holding the bushing within the spout assembly, and a lift rod passing through the opening of the bushing, wherein the bushing is supported for rotation within the retaining structure, and the threads of the bushing engage with the first set of spout anchor threads, and a portion of the retaining structure is positioned within the spout body and coupled thereto; and a valve cartridge surrounded by a locking ring, wherein the locking ring includes threads disposed on an external surface, the threads of the valve cartridge engaging with the first set of valve anchor threads.

2. The faucet assembly of claim 1, wherein the locking ring may rotate about the valve cartridge.

3. The faucet assembly of claim 2, wherein the locking ring is captured by the valve cartridge.

4. The faucet assembly of claim 2, further comprising a locking ring installation tool to rotate the locking ring.

5. The faucet assembly of claim 1, wherein the bushing is captured within the spout assembly to constrain movement along the longitudinal axis of the bushing.

6. The faucet assembly of claim 1, wherein the recessed portion of the bushing includes a flat portion positioned radially outward from the opening in the bushing.

7. The faucet assembly of claim 6, further comprising a spout installation tool to engage with the flat portion of the recessed portion of the bushing and rotate the bushing.

8. The faucet assembly of claim 1, wherein the spout anchor includes one or more projections, and further comprising an installation guide to engage with the one or more projections and align the spout anchor within an opening in the mounting deck.

9. The faucet assembly of claim 1, wherein the one or more valve anchors includes one or more projections, and further comprising an installation guide to engage with the one or more projections and align the one or more valve anchors within openings in a mounting deck.

10. The faucet assembly of claim 1, further comprising an orientation ring supported by the valve cartridge and including projections to orient the valve cartridge with cooperating recesses within the valve anchor.

11. A faucet assembly comprising:

a spout anchor including an upper portion configured to be supported above an upper surface of a mounting deck, and a lower portion configured to extend below the mounting deck, the upper portion including a first set of spout anchor threads;

a valve anchor including an upper portion configured to be supported above the upper surface of the mounting deck, and a lower portion configured to extend below the mounting deck, the upper portion including a first set of valve anchor threads;

a spout assembly including a spout body, a bushing having a first end with a recessed portion positioned internal of an external surface of the bushing and a second end with threads disposed on an external surface, an opening in the bushing extending from the recessed portion to the second end, a retaining structure holding the bushing within the spout assembly, and a lift rod passing through the opening of the bushing, wherein the bushing is supported for rotation within the retaining structure, and the threads of the bushing engage with the first set of spout anchor threads, and a portion of the retaining structure is positioned within the spout body and is coupled thereto; and a valve cartridge including a locking ring positioned on the external surface of the valve cartridge, wherein the locking ring includes threads disposed on the external surface, the locking ring threads engage with the first set of valve anchor threads, and the valve cartridge includes an inlet conduit and an outlet conduit, the inlet conduit and the outlet conduit being in fluid communication with the valve cartridge.

12. The faucet assembly of claim 11, wherein the bushing is captured within the spout assembly to constrain movement along the longitudinal axis of the bushing.

13. The faucet assembly of claim 11, wherein the recessed portion of the bushing includes a flat portion positioned radially outward from the opening in the bushing.

14. The faucet assembly of claim 13, further comprising a spout installation tool to engage with the flat portion of the recessed portion of the bushing and rotate the bushing.

15. The faucet assembly of claim 11, wherein the spout anchor includes one or more projections, and further comprising an installation guide to engage with the projections and align the spout anchor within an opening in the mounting deck.

16. The faucet assembly of claim 11, wherein the valve anchor includes one or more projections, and further comprising an installation guide to engage with the projections and align the valve anchor within an opening in the mounting deck.

17. The faucet assembly of claim 11, further comprising an orientation ring supported by the valve cartridge and including projections to orient the valve cartridge with cooperating recesses within the valve anchor.

18. A faucet assembly comprising:

a spout anchor including a first set of spout anchor threads; and a spout assembly including a spout body, a bushing having a first end with a recessed portion positioned internal of an external surface of the bushing and a second end with threads disposed on an external surface, an opening in the bushing extending from the recessed portion to the second end, a retaining structure holding the bushing within the spout assembly, a trim ring supported intermediate the spout anchor and the retaining structure, at least one fastener securing the trim ring and the retaining structure to the spout body, and a lift rod passing through the opening of the bushing, wherein the threads of the bushing engage with the first set of spout anchor threads, and the bushing is captured within the spout assembly to constrain movement along the longitudinal axis of the bushing while permitting rotation about the longitudinal axis within the retaining structure, and a portion of the retaining structure is positioned within the spout body and coupled thereto.

19. The faucet assembly of claim 18, further comprising:

a valve anchor including a first set of valve anchor threads; and a valve cartridge surrounded by a locking ring, wherein the locking ring includes threads disposed on an external surface, the threads of the valve cartridge engaging with the first set of valve anchor threads.

20. The faucet assembly of claim 18, wherein the recessed portion of the bushing includes a flat portion positioned radially outward from the opening in the bushing.

* * * * *